United States Patent [19]

Eckhardt

[11] 4,371,807

[45] Feb. 1, 1983

[54] INCANDESCENT LAMP WITH MECHANICALLY ATTACHED BASE

[75] Inventor: Frizt Eckhardt, Herbrechtingen-Bolheim, Fed. Rep. of Germany

[73] Assignee: Patent-Treuhand-Gesellschaft fur Elektrische Glühlampen mbH, Munich, Fed. Rep. of Germany

[21] Appl. No.: 183,349

[22] Filed: Sep. 2, 1980

[30] Foreign Application Priority Data

Sep. 21, 1979 [DE] Fed. Rep. of Germany ..... 2938189

[51] Int. Cl.[3] ..... H01J 5/48; H01J 5/50

[52] U.S. Cl. ..... 313/318; 313/315; 339/144 R; 339/146

[58] Field of Search ..... 313/315, 318; 339/144 R, 145 R, 146 R

[56] References Cited

U.S. PATENT DOCUMENTS

| | | | |
|---|---|---|---|
| 3,262,001 | 7/1966 | Rijckeart | 313/318 X |
| 3,417,367 | 12/1968 | Dayton et al. | 313/318 |
| 3,898,506 | 8/1975 | Wright et al. | 313/318 |
| 4,013,335 | 3/1977 | Varkonyi et al. | 313/318 |
| 4,122,367 | 10/1978 | Esklavon et al. | 313/318 |
| 4,295,076 | 10/1981 | Eckhardt et al. | 313/318 |

*Primary Examiner*—Saxfield Chatmon, Jr.

*Attorney, Agent, or Firm*—Frishauf, Holtz, Goodman & Woodward

[57] ABSTRACT

To attach the base to a lamp without using base cement, adhesive or the like, the base is made as a two-part element, one being an outer base sleeve and the other an inner insert snugly matching the inner diameter of the base sleeve or shell. The insert has an annular bottom and longitudinally extending flaps with inwardly bent wings which resiliently press and engage the press seal of the lamp, thereby holding the socket in position.

4 Claims, 3 Drawing Figures

INCANDESCENT LAMP WITH MECHANICALLY ATTACHED BASE

The present invention relates to an incandescent lamp having a base shell mechanically secured thereto in the region of the press seal.

THE INVENTION

It is the object of the invention to provide an incandescent lamp with a base shell in the press seal region and whose mechanical base support is simpler, safer and less expensive than prior art devices, and especially which does not require adhesives or cement.

Briefly, the base shell and the lamp press are secured together by a sleevelike insert snugly matching the inner diameter of the base shell. The insert has an annular bottom. Diametrically opposite flaps formed by a diametrical cut, extend along the base shell. The end portions form in-turned wings. The wings are inwardly bent. A knob, or punch, in one of the flaps, engages a matching recess, or projection in the base shell to prevent relative rotation. The side ends of the wings resiliently abut the press seal.

DRAWINGS

Figure 3:
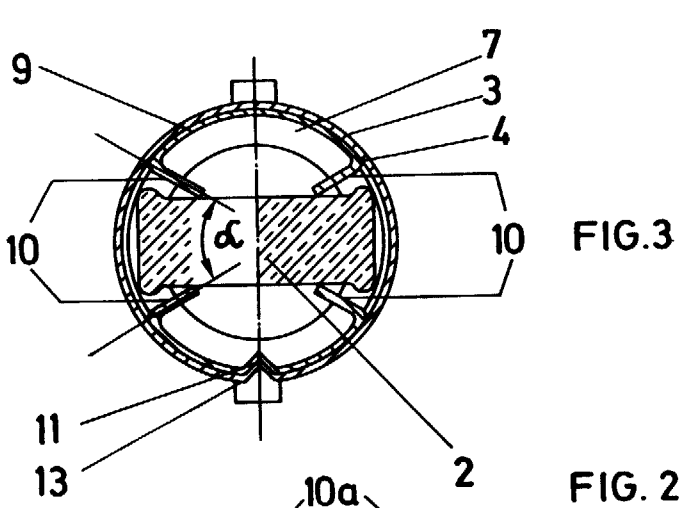
FIG. 3 shows a cut through the lamp of FIG. 1 along the line A—A in top view.
Figure 2:
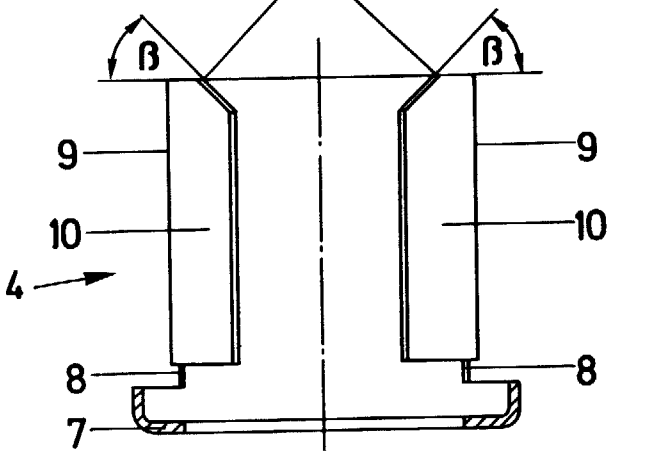
FIG. 2 shows the sleevelike insert partially in section.
Figure 1:
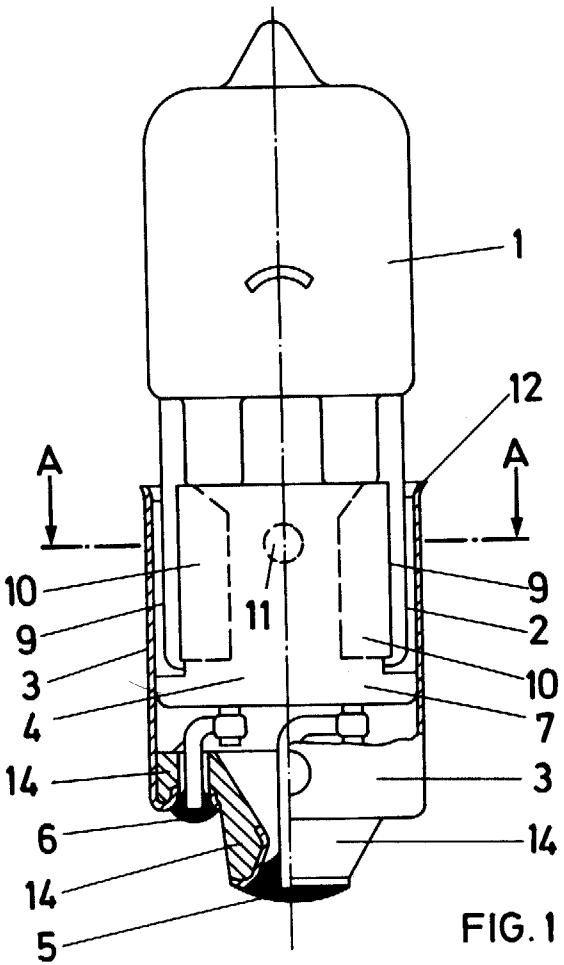
FIG. 1 shows a halogen, incandescent lamp, partially in section with a mechanically secured base.

An incandescent lamp 1, for instance a halogen cycle incandescent lamp, has a press seal 2. In accordance with the invention, a base shell 3 of essentially circular cross section, for instance a bayonet-type base shell is mechanically attached to and supported on the lamp by means of a sleevelike insert 4. The lead-in wires pass through the press seal 2 of lamp 1 to the exterior and terminate in the base contacts 5, 6 of the base insulator 14 as well known (FIG. 1). The sleeve-like insert 4 snugly matches the inner diameter of the base shell 3. The insert 4 is provided with an annular bottom 7. The tubular portion of the sleeve-like insert is longitudinally cut to form two part tubular portions or diametrically opposite flaps 9 which extend longitudinally of the lamp. The side ends 10 of the flaps 9 are formed as wings which are bent inwardly and include an angle $\alpha$ of between 30° and 80°. The wings 10 resiliently abut the press seal 2 of the lamp (FIGS. 2, 3). The wings 10 are shorter than the flaps 9, by being cut at the bottom as seen at 8.

In order to prevent changes in position, the insert 4 is secured by a bulge, bump or knob 11 in one of the flaps 9 and a matching recess 13 in the tubular portions, or base shell 3 which engage in interlocking manner. The insert 4 inserted in the base shell 3 extends close to the upper edge 12 of the base shell and is preferably flush with the base shell edge. The upper edges 10*a* of the wings 10 are partly beveled relative to the horizontal at an angle $\beta$ of less than about 80°. The insert 4 is made of sheet brass having a thickness of from 0.2 to 0.4 mm.

Various changes and modifications may be made; for example, base 3 may be a screw base or prong cap or the like instead of the bayonet base.

We claim:

1. Incandescent lamp having a lamp bulb (1) and a press seal (2) joined to the lamp bulb;

a tubular base shell (3) of essentially circular cross section;

and means for securing the lamp bulb in the base shell comprising a sleeve-like insert (4) snugly matching the inner diameter of the base shell (3) said insert including an annular bottom (7) fitted within the base shell;

the sleeve-like insert being diametrically severed to form diametrically opposite sleeve portions defining upstanding flaps (9) having part-cylindrical portions extending along the side walls of the base shell, the end portions of said upstanding flaps being bent inwardly of the sleeve-like insert, to form inwardly facing wings (10), said wings resiliently abutting and being pressed against the press seal;

and an interlocking projection and recess means formed in one of the flap (9) and in the base shell to lock said sleeve-like insert (4) and said base shell (3) together and to prevent rotation of the sleeve like insert relative to the base shell.

2. Lamp as claimed in claim 1 wherein the wings (10) lying opposite one another at the press seal (2) include an angle $\alpha$ of between 30° and 80°.

3. Lamp according to claim 1 wherein the upper edges (10*a*) of the wings (10) are partly beveled relative to a plane parallel with said angular bottom (7) at an angle $\beta$ of less than about 80°.

4. Lamp according to claim 2 wherein the upper edges (10*a*) of the wings (10) are partly beveled relative to a plane parallel with said angular bottom (7) at an angle $\beta$ of less than about 80°.

* * * * *